US008349785B2

(12) United States Patent
Kessler et al.

(10) Patent No.: US 8,349,785 B2
(45) Date of Patent: Jan. 8, 2013

(54) MACHINE DISHWASHER DETERGENT

(75) Inventors: Arnd Kessler, Monheim am Rhein (DE); Christian Nitsch, Dusseldorf (DE); Thorsten Bastigkeit, Wuppertal (DE); Johannes Zipfel, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/329,435

(22) Filed: Dec. 19, 2011

(65) Prior Publication Data

US 2012/0090644 A1 Apr. 19, 2012

Related U.S. Application Data

(63) Continuation of application No. PCT/EP2010/058537, filed on Jun. 17, 2010.

(30) Foreign Application Priority Data

Jun. 24, 2009 (DE) ..... 10 2009 027 158

(51) Int. Cl.
*C11D 17/00* (2006.01)

(52) U.S. Cl. ..... 510/220; 510/293; 510/295; 510/300

(58) Field of Classification Search ..... 510/220, 510/293, 295, 300
See application file for complete search history.

(56) References Cited

U.S. PATENT DOCUMENTS

| | | | | |
|---|---|---|---|---|
| 6,962,898 | B2 * | 11/2005 | Kessler et al. | 510/223 |
| 7,026,276 | B2 * | 4/2006 | Kessler et al. | 510/220 |
| 7,041,628 | B2 * | 5/2006 | Sunder et al. | 510/223 |
| 7,192,911 | B2 * | 3/2007 | Sunder et al. | 510/223 |
| 7,205,266 | B2 * | 4/2007 | Holderbaum et al. | 510/224 |
| 7,335,629 | B2 * | 2/2008 | Gentschev et al. | 510/311 |
| 7,462,588 | B2 * | 12/2008 | Bayersdoerfer et al. | 510/220 |
| 2003/0158064 | A1 * | 8/2003 | Kessler et al. | 510/220 |
| 2004/0167048 | A1 * | 8/2004 | Sunder et al. | 510/220 |
| 2004/0219297 | A1 * | 11/2004 | Raehse et al. | 427/292 |
| 2005/0139608 | A1 * | 6/2005 | Muehlhausen et al. | 222/94 |
| 2008/0045441 | A1 * | 2/2008 | Schmiedel et al. | 510/514 |

FOREIGN PATENT DOCUMENTS

| | | | |
|---|---|---|---|
| DE | 2038103 | A1 | 2/1972 |
| DE | 102005062479 | A1 | 7/2007 |
| DE | 102007039655 | A1 | 2/2009 |
| DE | 102007042857 | A1 | 3/2009 |
| EP | 0561446 | A2 | 9/1993 |
| EP | 1026230 | A1 | 8/2000 |
| EP | 1759624 | A2 | 3/2007 |

OTHER PUBLICATIONS

PCT International Search Report (PCT/EP2010/058537) dated Sep. 27, 2010.

* cited by examiner

*Primary Examiner* — Gregory Webb
(74) *Attorney, Agent, or Firm* — Thomas G. Krivulka

(57) ABSTRACT

Cleaning agent combinations comprising a cleaning agent preparation B further comprising: (b1) at least one non-ionic surfactant; and (b2) at least one active cleaning enzyme; and a rinsing composition C further comprising: (c1) at least one non-ionic surfactant, are by virtue of their thermal stability particularly suitable for automatic dosing in automatic dishwashing. The cleaning agent combinations of the present invention also have the characterizing feature of markedly improved cleaning performance in comparison to conventional methods.

16 Claims, No Drawings

MACHINE DISHWASHER DETERGENT

CROSS-REFERENCE TO RELATED APPLICATIONS

This application is a continuation of PCT Application Ser. No. PCT/EP2010/058537, filed on Jun. 17, 2010, which claims priority under 35 U.S.C. §119 to 10 2009 027 158.9 (DE), filed on Jun. 24, 2009. The disclosures PCT/EP2010/058537 and DE 10 2009 027 158.9 are hereby incorporated by reference in their entirety.

FIELD OF THE INVENTION

The present application describes surfactant-containing automatic dishwashing agents, automatic dishwashing methods using said automatic dishwashing agents, and the use of said dishwashing agents in automatic dishwashing methods, in which partial amounts of an automatic dishwashing agent are dosed from a supply reservoir located inside the automatic dishwasher into the interior of the dishwasher during the course of multiple successive wash cycles.

BACKGROUND OF THE INVENTION

When assessing modern automatic dishwashing agents, the consumer's interest is centered both on the performance aspects of these agents, in other words their cleaning and rinsing performance in particular, and on their manageability.

One of the principal objectives of manufacturers of automatic dishwashing agents is to improve the cleaning and rinsing performance of these agents, with greater focus being placed in recent times on cleaning and rinsing performance in low-temperature wash cycles and in wash cycles with reduced water consumption.

Typical presentation forms for dishwashing agents include in addition to traditional liquid washing-up liquids in particular also automatic dishwashing agents which are marketed predominantly in solid form and which are available for example as powders or tablets. These known packaging and presentation forms are however constantly undergoing new changes. A primary focus of attention in recent times has been the simplified dosing of automatic dishwashing agents.

In this context product developers have in recent times begun to turn their attention for example to devices for the multiple dosing of washing and cleaning agents. A distinction can be made with these devices between dosing containers which are integrated in the automatic dishwasher or washing machine on the one hand and standalone devices which are independent from the automatic dishwasher or washing machine on the other. By means of these devices, which contain multiples of the amount of cleaning agent necessary for one cleaning process, portions of washing or cleaning agent are dosed automatically or semi-automatically into the interior of the washing appliance during the course of several successive cleaning processes. For the consumer this eliminates the need to keep manually adding the washing and cleaning agents. Examples of such devices are described in the European patent application EP 1 759 624 A2 (Reckitt Benckiser) or in the German patent application DE 10 2005 062 479 A1 (BSH Bosch and Siemens Hausgeräte GmbH).

Irrespective of the precise construction of the dosing devices used in the interior of automatic dishwashers or washing machines, the washing or cleaning agents contained in these devices for multiple dosing are exposed in particular to fluctuating temperatures over an extended period of time, these temperatures being similar in a first approximation to the water temperatures used for the washing or cleaning processes. These temperatures can be up to 95° C., although temperatures of only between 50 and 75° C. are conventionally reached in automatic dishwashing. Accordingly, during the course of several washing or cleaning processes, a washing or cleaning agent contained in a device designed for multiple dosing is repeatedly heated to temperatures well above the conventional transport and storage temperatures, with heat-sensitive active substances being affected in particular. This group of heat-sensitive active washing and cleaning substances primarily includes active washing and cleaning enzymes.

A range of different protective measures have been proposed to increase the stability of such enzyme-containing liquid washing or cleaning agents. Thus for example the German patent application DE 2 038 103 (Henkel) teaches the stabilization of enzyme-containing automatic dishwashing agents with saccharides, while propylene glycol for enzyme stabilization in liquid cleaning agents is disclosed in the European patent EP 646 170 B1 (Procter & Gamble).

Accordingly, it is desirable to provide an automatic dishwashing agent which is stabilized to prevent phase separation/loss of activity under repeated temperature fluctuations (10 to 75° C.), and which can be stored in a supply device located in the interior of an automatic dishwasher with no significant loss of activity. In addition, it is desirable to provide an automatic dishwashing agent that has an improved performance profile in comparison to conventional automatic dishwashing agents. Furthermore, other desirable features and characteristics of the present invention will become apparent from the subsequent detailed description of the invention and the appended claims, taken in conjunction with the background of the invention.

BRIEF SUMMARY OF THE INVENTION

It has now been surprisingly found that an automatic dishwashing agent stabilized to prevent phase separation/loss of activity under repeated temperature fluctuations is achieved with a cleaning agent combination comprising two surfactant-containing preparations, one of which also contains an enzyme in addition to the surfactant.

In general, the present invention is a cleaning agent combination for automatic dosing in automatic dishwashing, comprising: a cleaning agent preparation B further comprising: b1) at least one non-ionic surfactant; and b2) at least one active cleaning enzyme; and, a rinsing composition C, further comprising: c1) at least one non-ionic surfactant.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The present application describes and claims a cleaning agent combination for automatic dosing in automatic dishwashing. As mentioned above, the cleaning agent combinations according to the invention are intended for automatic dosing and for storage in a dosing device in the interior of the automatic dishwasher, where the amount stored therein is more than the amount of cleaning agent necessary for one cleaning cycle. Therefore, the present invention is more specifically a cleaning agent combination for automatic dosing in automatic dishwashing, comprising: (a) a cleaning agent preparation B further comprising: b1) at least one non-ionic surfactant; and b2) at least one active cleaning enzyme; and, (b) a rinsing composition C, further comprising: c1) at least one non-ionic surfactant, and wherein the cleaning agent combination encompasses sufficient amounts of the cleaning agents B and C for at least two, preferably at least four, and in particular at least eight, automatic dishwasher processes.

In a preferred embodiment of the present invention, cleaning agent combinations comprising at least one, and preferably both, of the cleaning agent preparations B and C is liquid. In addition to water, additional organic solvents known to the person skilled in the art may be included. Such solvents suitable for these liquid cleaning agent preparations are preferably the monohydric or polyhydric alcohols.

With that in mind, a preferred embodiment of the present invention is a cleaning agent combination for automatic dosing in automatic dishwashing, comprising: (a) a liquid cleaning agent preparation B further comprising: b1) at least one non-ionic surfactant; and b2) at least one active cleaning enzyme; and, (b) a liquid rinsing composition C, further comprising: c1) at least one non-ionic surfactant, and wherein the cleaning agent combination encompasses sufficient amounts of the cleaning agents B and C for at least two, preferably at least four, and in particular at least eight, automatic dishwasher processes.

Both the cleaning agent preparation B and the cleaning agent preparation C contain non-ionic surfactant. Each of the cleaning agent preparations B and C can contain one, two or more non-ionic surfactants. The non-ionic surfactants in the cleaning agent preparations B and C can be identical or can have differing chemical structures. The cleaning agent preparations B and C have differing compositions, i.e. they are not identical.

For the cleaning and rinsing effect it has proved advantageous for the percentage by weight of non-ionic surfactant in the total weight of cleaning agent preparation B to be between 0.1 and 30 wt. %, preferably between 1.0 and 25 wt. %, particularly preferably between 2.0 and 20 wt. % and in particular between 5.0 and 15 wt. %.

With a constant surfactant content, such cleaning agent combinations according to the invention in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B have particularly advantageous cleaning and rinsing effects.

Exemplary compositions for some liquid cleaning agent combinations according to the invention, in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B, are shown in TABLE 1 below. In TABLE 1, and in all subsequent tables, "B" refers to "cleaning agent preparation B"; C refers to "cleaning agent preparation C"; and, "- -" indicates the preparation is free of this particular constituent.

TABLE 1

Exemplary Cleaning Agent Combinations

| | Formulation 1 | | Formulation 2 | |
|---|---|---|---|---|
| Ingredients (in wt. %) | B | C | B | C |
| Non-ionic Surfactant | 0.1 to 30 | yes | 2.0 to 20 | yes |
| Enzyme | yes | — | yes | — |
| Misc. | to 100 | to 100 | to 100 | to 100 |

A substantial constituent of the washing or cleaning agent preparations B and C according to the invention are non-ionic surfactants. Non-ionic surfactants having the general formula $R^1$—CH(OH)$CH_2$O-$(AO)_w$-$(A'O)_x(A''O)_y$-$(A'''O)_z$—$R^2$ are preferred in which, $R^1$ denotes a straight-chain or branched, saturated or mono- or polyunsaturated $C_{6-24}$ alkyl or alkenyl residue;

$R^2$ denotes a linear or branched hydrocarbon residue having 2 to 26 carbon atoms;

A, A', A'' and A''' independently of one another denote a residue from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$); and w, x, y and z denote values between 0.5 and 120, wherein x, y and/or z can also be 0.

In terms of the desired improvement of the cleaning and rinsing performance in the automatic dishwashing agents according to the invention for automatic dosing, these surfactants have proved to be superior to other known non-ionic surfactants found in the prior art.

Surprisingly, the rinsing result of enzyme-containing preparations according to the invention may be markedly improved by the addition of the aforementioned non-ionic surfactants of the general formula $R^1$—CH(OH)$CH_2$O-$(AO)_w$-$(A'O)_w$-$(A''O)_y$-$(A'''O)_z$—$R^2$, also referred to below as "hydroxy mixed ethers", in comparison both to surfactant-free systems and to systems containing alternative non-ionic surfactants such as the polyalkoxylated fatty alcohols.

When the aforementioned hydroxy mixed ethers are used in both the cleaning agent preparation B and in the cleaning agent preparation C, filming on surfaces such as glass, plastic or stainless steel can also be improved in addition to the rinsing result. This improvement is discernible by comparison with an automatic dishwashing agent containing the same amount of hydroxy mixed ether in only one of the two cleaning agent preparations B or C.

The stability of the enzymes contained in the washing or cleaning agent preparations according to the invention can be improved markedly by the use of these non-ionic surfactants having one or more free hydroxyl groups on one or both terminal alkyl residues.

Such end-capped poly(oxyalkylated) non-ionic surfactants are preferred in particular which according to the formula $R^1O[CH_2CH_2O]_xCH_2CH(OH)R^2$ also have, in addition to a residue $R^1$, which denotes linear or branched, saturated or unsaturated, aliphatic or aromatic hydrocarbon residues having 2 to 30 carbon atoms, preferably 4 to 22 carbon atoms, a linear or branched, saturated or unsaturated, aliphatic or aromatic hydrocarbon residue $R^2$ having 1 to 30 carbon atoms, in which x denotes values between 1 and 90, preferably values between 30 and 80 and in particular values between 30 and 60.

Surfactants of the formula $R^1O[CH_2CH(CH_3)O]_x[CH_2CH_2O]_yCH_2CH(OH)R^2$ are particularly preferred, in which $R^1$ denotes a linear or branched aliphatic hydrocarbon residue having 4 to 18 carbon atoms or mixtures thereof, $R^2$ denotes a linear or branched hydrocarbon residue having 2 to 26 carbon atoms or mixtures thereof, and x denotes values between 0.5 and 1.5 and y denotes a value of at least 15. The group of these non-ionic surfactants includes for example the $C_{2-26}$ fatty alcohol-$(PO)_1$-$(EO)_{15-40}$-2-hydroxyalkyl ethers, in particular also the $C_{8-10}$ fatty alcohol-$(PO)_1$-$(EO)_{22}$-2-hydroxydecyl ethers.

Also, particularly preferred are such end-capped poly(oxyalkylated) non-ionic surfactants of the formula $R^1O[CH_2H_2O]_x[CH_2CH(R^3)O]_yCH_2CH(OH)R^2$ in which $R^1$ and $R^2$ independently of each other denote a linear or branched, saturated or mono- or polyunsaturated hydrocarbon residue having 2 to 26 carbon atoms, $R^3$ is selected independently from —$CH_3$, —$CH_2CH_3$, —$CH_2CH_2$—$CH_3$, —$CH(CH_3)_2$, but preferably denotes —$CH_3$, and x and y independently of each other denote values between 1 and 32, wherein non-ionic surfactants having $R^3$=—$CH_3$ and values for x of 15 to 32 and y of between 0.5 and 1.5 are most particularly preferred.

Other non-ionic surfactants that can preferably be used are the end-capped poly(oxyalkylated) non-ionic surfactants of the formula $R^1O[CH_2CH(R^3)O]_x[CH_2]_kCH(OH)[CH_2]_jOR^2$, in which $R^1$ and $R^2$ denote linear or branched, saturated or unsaturated, aliphatic or aromatic hydrocarbon residues having 1 to 30 carbon atoms, $R^3$ denotes H or a methyl, ethyl, n-propyl, isopropyl, n-butyl, 2-butyl or 2-methyl-2-butyl residue, x denotes values between 1 and 30, k and j denote values between 1 and 12, preferably between 1 and 5. If the value x≧2, each $R^3$ in the above formula $R^1O[CH_2CH(R^3)O]_x[CH_2]_kCH(OH)[CH_2]_jOR^2$ can be different. $R^1$ and $R^2$ are preferably linear or branched, saturated or unsaturated, aliphatic or aromatic hydrocarbon residues having 6 to 22 carbon atoms, with residues having 8 to 18 C atoms being particularly preferred. H, —$CH_3$ or —$CH_2CH_3$ are particularly preferred for the residue $R^3$. Particularly preferred values for x are in the range from 1 to 20, preferably 6 to 15.

As is described above, each $R^3$ in the above formula can be different if x≧2. The alkylene oxide unit in the square brackets can be varied in this way. For example, if x denotes 3, the residue $R^3$ can be selected in order to form ethylene oxide ($R^3$=H) or propylene oxide ($R^3$=$CH_3$) units, which can be combined in any sequence, for example (EO)(PO)(EO), (EO)(EO)(PO), (EO)(EO)(EO), (PO)(EO)(PO), (PO)(PO)(EO) and (PO)(PO)(PO). The value of 3 for x is chosen here by way of example and can certainly be greater, in which case the variation range increases as the value of x increases, and includes for example a large number of (EO) groups combined with a small number of (PO) groups or vice versa.

Particularly preferred end-capped poly(oxyalkylated) alcohols of the above formula have values of k=1 and j=1, so that the above formula can be simplified to $R^1O[CH_2CH(R^3)O]_xCH_2CH(OH)CH_2OR^2$. In this last formula $R^1$, $R^2$ and $R^3$ are as defined above and x denotes values from 1 to 30, preferably from 1 to 20 and in particular from 6 to 18. Surfactants in which residues $R^1$ and $R^2$ have 9 to 14 C atoms, $R^3$ denotes H and x assumes values from 6 to 15 are particularly preferred.

Finally, the non-ionic surfactants of the general formula $R^1$—$CH(OH)CH_2O$-$(AO)_w$—$R^2$ have proved to be particularly effective, in which, $R^1$ denotes a straight-chain or branched, saturated or mono- or polyunsaturated $C_{6-24}$ alkyl or alkenyl residue;

$R^2$ denotes a linear or branched hydrocarbon residue having 2 to 20 carbon atoms;

A denotes a residue from the group $CH_2CH_2$, —$CH_2CH_2$—$CH_2$, —$CH_2$—$CH(CH_3)$; and w denotes values between 10 and 120, preferably from 10 to 80, and in particular 20 to 40.

The group of these non-ionic surfactants includes for example the $C_{4-22}$ fatty alcohol-$(EO)_{10-80}$-2-hydroxyalkyl ethers, in particular also the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

Cleaning agent combinations according to the invention, wherein as the non-ionic surfactant in composition B and/or C a surfactant of the general formula $R^1CH(OH)CH_2O$—$(CH_2CH_2O)_{10-120}$—$R^2$ is used, in which $R^1$ and $R^2$ independently of each other denote a linear or branched aliphatic hydrocarbon residue having 2 to 20 carbon atoms, are preferred according to the invention.

The cleaning agent preparations B of the cleaning agent combinations according to the invention contain at least one active washing or cleaning enzyme as a further substantial constituent. The percentage by weight of the active washing or cleaning enzyme in the total weight of cleaning agent preparation B is preferably between 5 and 80 wt. %, preferably between 5 and 60 wt. %, particularly preferably between 10 and 50 wt. % and in particular between 10 and 30 wt. %.

Further exemplary compositions of some liquid cleaning agent combinations according to the invention, in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B, are shown in TABLE 2 below.

TABLE 2

Exemplary Cleaning Agent Combinations

| | Formulation 1 | | Formulation 2 | |
|---|---|---|---|---|
| Ingredients (in wt. %) | B | C | B | C |
| Non-ionic Surfactant | 0.1 to 30 | yes | 2.0 to 20 | yes |
| Enzyme | 5 to 80 | — | 10 to 30 | — |
| Misc. | to 100 | to 100 | to 100 | to 100 |

In another preferred embodiment, the cleaning agent combination according to the present invention comprises a non-ionic surfactant of the general formula $R^1O(AlkO)_xM(OAlk)_yOR^2$, in which, $R^1$ and $R^2$ independently of each other denote a branched or unbranched, saturated or unsaturated, optionally hydroxylated alkyl residue having 4 to 22 carbon atoms;

Alk denotes a branched or unbranched alkyl residue having 2 to 4 carbon atoms;

x and y independently of each other denote values between 1 and 70; and

M denotes an alkyl residue from the group $CH_2$, $CHR^3$, $CR^3R^4$, $CH_2CHR^3$ and $CHR^3CHR^4$, in which $R^3$ and $R^4$ independently of each other denote a branched or unbranched, saturated or unsaturated alkyl residue having 1 to 18 carbon atoms.

These specific non-ionic surfactants are referred to below as Y-surfactants.

Particularly preferred non-ionic surfactants in the group of Y-surfactants include the following two groups:

(1) non-ionic surfactants having the general formula $R^1$—$CH(OH)CH_2$—$O(CH_2CH_2O)_xCH_2CHR(OCH_2CH_2)_yO$—$CH_2CH(OH)$—$R^2$, in which: R, $R^1$ and $R^2$ independently of one another denote an alkyl residue or alkenyl residue having 6 to 22 carbon atoms; and, x and y independently of each other denote values between 1 and 40; and (2) non-ionic surfactants having the general formula $R^1$—O$(CH_2CH_2O)_xCH_2(OCH_2CH_2)_yO$—$R^2$, in which: $R^1$ and $R^2$ independently of each other denote an alkyl residue or alkenyl residue having 4 to 22 carbon atoms; and, x and y independently of each other denote values between 1 and 40.

The Y-surfactants can be a constituent of the cleaning agent preparation B and/or cleaning agent preparation C. The one or more Y-surfactants are preferably used in combination with one or more hydroxy mixed ethers. The combination of hydroxy mixed ethers and Y-surfactant has proven to particularly improve rinsing performance. The best rinsing results were obtained with the addition of Y-surfactants to the cleaning agent composition C, wherein these results could be improved in turn by adding hydroxy mixed ethers to the cleaning agent preparation B and C.

The present application therefore preferably provides a cleaning agent combination for automatic dosing in automatic dishwashing, comprising: (a) a cleaning agent preparation B further comprising: b1) at least one non-ionic surfactant; and b2) at least one active cleaning enzyme; and, (b) a rinsing composition C, further comprising: c1) at least one non-ionic surfactant of the general formula $R^1O(AlkO)_xM(OAlk)_yOR^2$, in which:

$R^1$ and $R^2$ independently of each other denote a branched or unbranched, saturated or unsaturated, optionally hydroxylated alkyl residue having 4 to 22 carbon atoms;

Alk denotes a branched or unbranched alkyl residue having 2 to 4 carbon atoms;

x and y independently of each other denote values between 1 and 70; and

M denotes an alkyl residue from the group $CH_2$, $CHR^3$, $CR^3R^4$, $CH_2CHR^3$ and $CHR^3CHR^4$, in which $R^3$ and $R^4$ independently of each other denote a branched or unbranched, saturated or unsaturated alkyl residue having 1 to 18 carbon atoms.

Cleaning agent combinations for automatic dosing in automatic dishwashing are particularly preferred that comprise (a) a cleaning agent preparation B containing (b1) at least one non-ionic surfactant of the general formula $R^1$—CH(OH)$CH_2O$-$(AO)_w$—$R^2$, in which: $R^1$ denotes a straight-chain or branched, saturated or mono- or polyunsaturated $C_{6-24}$ alkyl or alkenyl residue; $R^2$ denotes a linear or branched hydrocarbon residue having 2 to 20 carbon atoms; A denotes a residue from the group $CH_2CH_2$, —$CH_2CH_2$—$CH_2$, —$CH_2$—CH$(CH_3)$; and, w denotes values between 10 and 120, preferably from 10 to 80, in particular 20 to 40; and (b2) at least one active cleaning enzyme; and, (b) a rinsing composition C containing (c2) at least one non-ionic surfactant of the general formula $R^1O(AlkO)_xM(OAlk)_yOR^2$, in which: $R^1$ and $R^2$ independently of each other denote a branched or unbranched, saturated or unsaturated, optionally hydroxylated alkyl residue having 4 to 22 carbon atoms; Alk denotes a branched or unbranched alkyl residue having 2 to 4 carbon atoms; x and y independently of each other denote values between 1 and 70; and M denotes an alkyl residue from the group $CH_2$, $CHR^3$, $CR^3R^4$, $CH_2CHR^3$ and $CHR^3CHR^4$, in which $R^3$ and $R^4$ independently of each other denote a branched or unbranched, saturated or unsaturated alkyl residue having 1 to 18 carbon atoms.

Cleaning agent combinations for automatic dosing in automatic dishwashing are most particularly preferred that comprise:

(a) a cleaning agent preparation B containing:

(b1) at least one non-ionic surfactant of the general formula $R^1$—CH(OH)$CH_2O$-$(AO)_w$—$R^2$, in which $R^1$ denotes a straight-chain or branched, saturated or mono- or polyunsaturated $C_{6-24}$ alkyl or alkenyl residue; $R^2$ denotes a linear or branched hydrocarbon residue having 2 to 20 carbon atoms; A denotes a residue from the group $CH_2CH_2$, —$CH_2CH_2$—$CH_2$, —$CH_2$—CH$(CH_3)$; and, w denotes values between 10 and 120, preferably from 10 to 80, in particular 20 to 40; and (b2) at least one active cleaning enzyme; and, (b) a rinsing composition C containing:

(c1) at least one non-ionic surfactant of the general formula $R^1$—CH(OH)$CH_2O$-$(AO)_w$—$R^2$, in which: $R^1$ denotes a straight-chain or branched, saturated or mono- or polyunsaturated $C_{6-24}$ alkyl or alkenyl residue; $R^2$ denotes a linear or branched hydrocarbon residue having 2 to 20 carbon atoms; A denotes a residue from the group $CH_2CH_2$, —$CH_2CH_2$—$CH_2$, —$CH_2$—CH$(CH_3)$; and, w denotes values between 10 and 120, preferably from 10 to 80, in particular 20 to 40; and, (c2) at least one non-ionic surfactant of the general formula $R^1O(AlkO)_xM(OAlk)_yOR^2$, in which: $R^1$ and $R^2$ independently of each other denote a branched or unbranched, saturated or unsaturated, optionally hydroxylated alkyl residue having 4 to 22 carbon atoms; Alk denotes a branched or unbranched alkyl residue having 2 to 4 carbon atoms; x and y independently of each other denote values between 1 and 70; and M denotes an alkyl residue from the group $CH_2$, $CHR^3$, $CR^3R^4$, $CH_2CHR^3$ and $CHR^3CHR^4$, in which $R^3$ and $R^4$ independently of each other denote a branched or unbranched, saturated or unsaturated alkyl residue having 1 to 18 carbon atoms.

The percentage by weight of Y-surfactants in the total weight of the cleaning agent combination according to the invention is preferably between 0.2 and 15 wt. %, preferably between 0.5 and 12 wt. %, particularly preferably between 1.0 and 8.0 wt. % and in particular between 2.0 and 6.0 wt. %.

The automatic dishwashing agents according to the invention containing Y-surfactants preferably have a softening agent system, for example at least one polymer containing sulfonic acid groups.

Enzymes which are used according to the invention to particular advantage include in particular proteases, amylases, lipases, hemicellulases, cellulases, perhydrolases or oxidoreductases, and preferably mixtures thereof. These enzymes are of natural origin in principle; starting from the natural molecules, improved variants are available for use in washing or cleaning agents which accordingly are preferably used. Washing or cleaning agents preferably contain enzymes in total amounts of $1\times10^{-6}$ to 5 wt. %, relative to active protein. The protein concentration can be determined with the aid of known methods, for example the BCA method or the Biuret method.

The stabilizing effect according to the invention was observed to a particular extent in the amylases and proteases, for which reason cleaning agent preparations B according to the invention having the characterizing feature that they contain an active washing or cleaning enzyme from the group of amylases and/or proteases are preferred.

Of the proteases, those of the subtilisin type are preferred. Examples thereof are the subtilisins BPN' and Carlsberg and the developed forms thereof, the protease PB92, the subtilisins 147 and 309, the alkaline protease from *Bacillus lentus*, subtilisin DY, and the enzymes thermitase, proteinase K and the proteases TW3 and TW7, which can be assigned to the subtilases but no longer in the narrower sense to the subtilisins.

Cleaning agent preparations B that are preferred according to the invention contain, relative to the total weight of washing or cleaning agent preparation B, 5 to 50 wt. %, preferably 7 to 40 wt. % and in particular 10 to 30 wt. % of protease preparations. Cleaning agent preparations B containing, relative to their weight, 15 to 25 wt. % of protease preparations, are particularly preferred.

Examples of amylases which can be used according to the invention are the α-amylases from *Bacillus licheniformis*, from *B. amyloliquefaciens*, from *B. stearothermophilus*, from *Aspergillus niger* and *A. oryzae*, and the developed forms of the aforementioned amylases improved for use in washing and cleaning agents. Furthermore, the α-amylase from *Bacillus* sp. A 7-7 (DSM 12368) and the cyclodextrin glucanotransferase (CGTase) from *B. agaradherens* (DSM 9948) can be mentioned for this purpose.

Cleaning agent preparations B that are preferred according to the invention contain, relative to the total weight of cleaning agent preparation B, 0.1 to 30 wt. %, preferably 1.0 to 25 wt. % and in particular 2.0 to 20 wt. % of amylase preparations. Cleaning agent preparations B containing, relative to their weight, 4.0 to 16 wt. % of amylase preparations, are particularly preferred.

Active cleaning proteases and amylases are generally used not in the form of the pure protein but rather in the form of stabilized preparations which are capable of being stored and transported. Examples of these ready-to-use preparations include the solid preparations obtained by granulation, extrusion or lyophilization or, particularly in the case of agents in liquid or gel form, solutions of the enzymes, advantageously as concentrated as possible, with a low water content and/or mixed with stabilizers or other auxiliary agents.

For both the solid and the liquid presentation form, the enzymes can alternatively be encapsulated, for example by spray drying or extrusion of the enzyme solution together with a preferably natural polymer, or in the form of capsules, for example those in which the enzymes are enclosed as in a solidified gel or in those of the core-shell type, in which an enzyme-containing core is coated with a protective layer which is impermeable to water, air and/or chemicals. Further active ingredients, for example stabilizers, emulsifiers, pigments, bleaches or dyes, can additionally be applied in superimposed layers. Such capsules are applied by methods known per se, for example by vibrating or roll granulation or in fluidized-bed processes. Such granules are preferably low in dust, for example through the application of polymeric film formers, and stable in storage because of the coating.

It is also possible to make up two or more enzymes together so that a single granulated product has multiple enzyme activities.

As can be seen from the preceding statements, the enzyme protein forms only a fraction of the total weight of conventional enzyme preparations. Protease and amylase preparations preferably used according to the invention contain between 0.1 and 40 wt. %, preferably between 0.2 and 30 wt. %, particularly preferably between 0.4 and 20 wt. % and in particular between 0.8 and 10 wt. % of the enzyme protein.

Also suitable for use according to the invention are lipases or cutinases, in particular because of their triglyceride-cleaving activities but also in order to produce peracids in situ from suitable precursors. These include for example the lipases obtainable originally from *Humicola lanuginosa* (*Thermomyces lanuginosus*) or the further developments thereof, in particular those with the amino acid exchange D96L. Furthermore, the cutinases which were originally isolated from *Fusarium solani pisi* and *Humicola insolens* can also be used, for example. Lipases or cutinases whose starting enzymes were originally isolated from *Pseudomonas mendocina* and *Fusarium solanii* can also be used.

Enzymes which are grouped together under the term hemicellulases can moreover be used. They include for example mannanases, xanthan lyases, pectin lyases (=pectinases), pectinesterases, pectate lyases, xyloglucanases (=xylanases), pullulanases and β-glucanases.

To increase the bleaching action, oxidoreductases, for example oxidases, oxygenases, catalases, peroxidases, such as halo-, chloro-, bromo-, lignin, glucose or manganese peroxidases, dioxygenases or laccases (phenoloxidases, polyphenoloxidases) can be used according to the invention. Preferably organic, particularly preferably aromatic compounds which interact with the enzymes are advantageously additionally added to strengthen the activity of the oxidoreductases concerned (enhancers) or to ensure the flow of electrons in the case of very differing redox potentials between the oxidizing enzymes and the stains (mediators).

Multiple enzymes and/or enzyme preparations, preferably liquid protease preparations and/or amylase preparations, are preferably used.

Exemplary compositions of some liquid cleaning agent combinations according to the invention, in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B, are shown in TABLE 3 below.

TABLE 3

Exemplary Cleaning Agent Combinations

| | Formulation 1 | | Formulation 2 | |
|---|---|---|---|---|
| Ingredients (in wt. %) | B | C | B | C |
| Non-ionic surfactant | 0.1 to 30 | yes | 2.0 to 20 | yes |
| Protease preparation | 5.0 to 50 | — | 10 to 30 | — |
| Amylase preparation | 0.1 to 30 | — | 2.0 to 20 | — |
| Misc | to 100 | to 100 | to 100 | to 100 |

As mentioned previously, preferred cleaning agent combinations according to the invention encompass at least one liquid cleaning agent preparation, wherein in addition to water, further organic solvents known to the person skilled in the art, in particular the monohydric or polyhydric alcohols, are used as solvents.

The water content of the cleaning agent preparations can be between 10 and 90 wt. %, relative to their total weight. In a preferred embodiment cleaning agent preparation C in particular contains water in amounts of between 20 and 90 wt. %, preferably between 30 and 80 wt. % and in particular between 40 and 70 wt. %, relative to its total weight.

The term "water content" encompasses the entire amount of water contained in the agents according to the invention, consisting of the free water contained in the agents as well as the water introduced into the washing or cleaning agent preparations in bonded form via the active washing or cleaning. The water content can be determined for example as the loss on drying or by the Karl Fischer method.

A further preferred constituent of the washing or cleaning agent preparations B or C according to the invention is an organic solvent. Preferred organic solvents derive from the group of monohydric or polyhydric alcohols, alkanol amines or glycol ethers. The solvents are preferably selected from ethanol, n- or i-propanol, butanol, glycol, propane- or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy, ethoxy or butoxy triglycol, 1-butoxyethoxy-2-propanol, 3-methyl-3-methoxybutanol, propylene glycol-t-butyl ether and mixtures of these solvents. The percentage by weight of these organic solvents in the total weight of cleaning agent preparations according to the invention is preferably 5 to 80 wt. %, preferably 10 to 70 wt. % and in particular 12 to 60 wt. %.

A cleaning agent combination that is preferred according to the invention has the characterizing feature that the composition B and/or C, relative to its total weight, contains between 5.0 and 80 wt. %, preferably between 10 and 70 wt. % and in particular between 12 and 60 wt. % of organic solvent(s).

A particularly preferred organic solvent that is particularly effective in terms of stabilizing the enzyme-containing cleaning agent preparation B is 1,2-propylene glycol. The percentage by weight of 1,2-propylene glycol in the total weight of the cleaning agent preparation B according to the invention can vary within broad limits; however, preparations have proved to be particularly stable which contain an organic solvent, preferably 1,2-propylene glycol, wherein the percentage by weight of 1,2-propylene glycol, relative in each case to the total weight of the cleaning agent preparation B, is preferably 15 to 80 wt. %, by preference 30 to 70 wt. % and in particular 40 to 60 wt. %.

The repeated automatic dosing of these mixtures of active substances is simplified by the use of liquid cleaning agent preparations or liquid cleaning agent combinations.

Exemplary compositions of some liquid cleaning agent combinations according to the invention, in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B, are shown in TABLE 4 below.

TABLE 4

Exemplary Cleaning Agent Combinations

| | Formulation 1 | | Formulation 2 | |
|---|---|---|---|---|
| Ingredients (in wt. %) | B | C | B | C |
| Non-ionic surfactant | 2.0 to 20 | yes | 5.0 to 15 | yes |
| Protease preparation | 5.0 to 50 | — | 10 to 30 | — |
| Amylase preparation | 0.1 to 30 | — | 2.0 to 20 | — |
| Org. solvent | 5.0 to 80 | 5.0 to 60 | 12 to 60 | 12 to 60 |
| Water | 10 to 70 | 20 to 80 | 10 to 40 | 40 to 70 |
| Misc | to 100 | to 100 | to 100 | to 100 |

In addition to enzymes, solvents and non-ionic surfactants from the group of hydroxy mixed ethers described above, the washing or cleaning agent preparations B and C may contain additional constituents, such as for example active agents from the group of builders, bleaching agents, active washing and cleaning polymers, corrosion inhibitors, scents or dyes. However, in contrast to conventional washing or cleaning agents, the preferred washing or cleaning agent preparations B and C contain these additional constituents only to a minor degree.

Cleaning agent preparations B and C are preferred according to the invention in particular which contain less than 20 wt. %, preferably less than 10 wt. % and in particular less than 5 wt. % of builders. In particular, cleaning agent preparations B and C that are free from builders are particularly preferred.

Cleaning agent preparations B and C are furthermore preferred which contain less than 10 wt. %, preferably less than 5 wt. % and in particular less than 2 wt. % of bleaching agents. In particular, cleaning agent preparations B and C that are free from bleaching agents are particularly preferred.

Exemplary compositions of some liquid cleaning agent combinations according to the invention, in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B, are shown in TABLES 5a-5d below.

TABLE 5a

Exemplary Cleaning Agent Combinations

| | Formulation 1 | | Formulation 2 | |
|---|---|---|---|---|
| Ingredients (in wt. %) | B | C | B | C |
| Non-ionic surfactant | 2.0 to 20 | yes | 5.0 to 15 | yes |
| Protease preparation | 5.0 to 50 | — | 10 to 30 | — |
| Amylase preparation | 0.1 to 30 | — | 2.0 to 20 | — |
| Builders | <10 | <10 | <5 | <5 |
| Org. solvent | 5.0 to 80 | 5.0 to 60 | 12 to 60 | 12 to 60 |
| Water | 10 to 70 | 20 to 80 | 10 to 40 | 40 to 70 |
| Misc | to 100 | to 100 | to 100 | to 100 |

TABLE 5b

Exemplary Cleaning Agent Combinations

| | Formulation 3 | | Formulation 4 | |
|---|---|---|---|---|
| Ingredients (in wt. %) | B | C | B | C |
| Non-ionic surfactant | 2.0 to 20 | yes | 5.0 to 15 | yes |
| Protease preparation | 5.0 to 50 | — | 10 to 30 | — |
| Amylase preparation | 0.1 to 30 | — | 2.0 to 20 | — |
| Bleaching agent | <10 | — | — | — |
| Org. solvent | 5.0 to 80 | 5.0 to 60 | 12 to 60 | 12 to 60 |
| Water | 10 to 70 | 20 to 80 | 10 to 40 | 40 to 70 |
| Misc | to 100 | to 100 | to 100 | to 100 |

TABLE 5c

Exemplary Cleaning Agent Combinations

| | Formulation 5 | | Formulation 6 | |
|---|---|---|---|---|
| Ingredients (in wt. %) | B | C | B | C |
| Non-ionic surfactant | 2.0 to 20 | yes | 5.0 to 15 | yes |
| Protease preparation | 5.0 to 50 | — | 10 to 30 | — |
| Amylase preparation | 0.1 to 30 | — | 2.0 to 20 | — |
| Builders | <10 | <10 | <5 | <5 |
| Bleaching agent | <10 | — | — | — |
| Org. solvent | 5.0 to 80 | 5.0 to 60 | 12 to 60 | 12 to 60 |
| Water | 10 to 70 | 20 to 80 | 10 to 40 | 40 to 70 |
| Misc | to 100 | to 100 | to 100 | to 100 |

TABLE 5d

| Exemplary Cleaning Agent Combinations | | | | |
|---|---|---|---|---|
| | Formulation 7 | | Formulation 8 | |
| Ingredients (in wt. %) | B | C | B | C |
| Non-ionic surfactant (hydroxy mixed ethers group) | 2.0 to 20 | yes | 5.0 to 15 | yes |
| Non-ionic surfactant (Y-surfactants group) | optional | yes | optional | yes |
| Protease preparation | 5.0 to 50 | — | 10 to 30 | — |
| Amylase preparation | 0.1 to 30 | — | 2.0 to 20 | — |
| Builders | <10 | <10 | <5 | <5 |
| Bleaching agent | <10 | — | — | — |
| Org. solvent | 5.0 to 80 | 5.0 to 60 | 12 to 60 | 12 to 60 |
| Water | 10 to 70 | 20 to 80 | 10 to 40 | 40 to 70 |
| Misc | to 100 | to 100 | to 100 | to 100 |

Even if the aforementioned additional active washing or cleaning constituents are preferably contained to only a minor degree in the cleaning agent combinations according to the invention, in other words are mixed with them directly, it is nevertheless desirable for these further constituents to be packaged together with the cleaning agent combinations B and C to form a cleaning agent. To this end all packaging forms known to the person skilled in the art for combination products with a liquid component are available, wherein combination products have proved suitable in particular which allow three, four or more separate liquid preparations to be packaged together.

Cleaning agent combinations according to the invention comprising the cleaning agent preparations B and C preferably contain less than 10 wt. %, particularly preferably less than 5 wt. % and in particular less than 2 wt. % of phosphate. Phosphate-free cleaning agent combinations are most particularly preferred according to the invention. Cleaning agent combinations according to the invention comprising the cleaning agent preparations B and C are furthermore preferred which contain less than 5 wt. %, preferably less than 3 wt. % and in particular less than 1 wt. % of silicate. Most particularly preferred dishwasher cleaning agent combinations according to the invention are silicate-free. Reducing the phosphate content and reducing the silicate content have both proved advantageous for the stability of the cleaning agent combinations according to the invention.

Despite their good physical and chemical stability, the formulation of the cleaning agent combinations according to the invention is not highly complex. This lack of complexity simplifies the production of the cleaning agents and thus reduces the costs arising in the preparation of these cleaning agents.

In a further embodiment the cleaning agent combinations according to the invention are combined with one or more further cleaning agents.

The present application also provides a cleaning agent combination comprising: (a) a cleaning agent combination according to the invention comprising the cleaning agent preparations B and C; and, (b) at least one further cleaning agent preparation A differing from B and C.

The further cleaning agent preparation A combined with the cleaning agent combination according to the invention is preferably a cleaning agent containing builders.

The further cleaning agent preparation A combined with the cleaning agent combination according to the invention is preferably a liquid cleaning agent.

The further cleaning agent preparation A combined with the cleaning agent combination according to the invention is preferably a cleaning agent that is free from bleaching agents and/or phosphates.

The further cleaning agent preparation A combined with the cleaning agent combination according to the invention is preferably a surfactant-free cleaning agent.

The further cleaning agent preparation A combined with the cleaning agent combination according to the invention is preferably an enzyme-free cleaning agent.

The further cleaning agent preparation A combined with the cleaning agent combination according to the invention is to particular advantage a liquid cleaning agent containing builders and free from phosphates, bleaching agents, surfactants and enzymes.

Exemplary compositions of some liquid cleaning agent combinations according to the invention, in which at least 20 wt. %, preferably between 20 and 80 wt. %, particularly preferably between 30 and 75 wt. % and in particular between 40 and 70 wt. % of the total amount of surfactant in the cleaning agent combination is contained in cleaning agent preparation B, are shown in TABLES 6a-6h below. In TABLES 6a-6h, A refers to "cleaning agent preparation A.

TABLE 6a

| Exemplary Cleaning Agent Combinations | | | | | | |
|---|---|---|---|---|---|---|
| | Formulation 1 | | | Formulation 2 | | |
| Ingredients (in wt. %) | A | B | C | A | B | C |
| Non-ionic surfactant | optional | 2.0 to 20 | yes | optional | 5.0 to 15 | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Phosphate | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6b

| Exemplary Cleaning Agent Combinations | | | | | | |
|---|---|---|---|---|---|---|
| | Formulation 3 | | | Formulation 4 | | |
| Ingredients (in wt. %) | A | B | C | A | B | C |
| Non-ionic surfactant | optional | 2.0 to 20 | yes | optional | 5.0 to 15 | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6c

| Exemplary Cleaning Agent Combinations | | | | | | |
|---|---|---|---|---|---|---|
| | Formulation 5 | | | Formulation 6 | | |
| Ingredients (in wt. %) | A | B | C | A | B | C |
| Non-ionic surfactant | optional | 2.0 to 20 | yes | optional | 5.0 to 15 | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Phosphate | — | — | — | — | — | — |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6d

| Exemplary Cleaning Agent Combinations | | | | | | |
|---|---|---|---|---|---|---|
| | Formulation 7 | | | Formulation 8 | | |
| Ingredients (in wt. %) | A | B | C | A | B | C |
| Non-ionic surfactant | optional | 2.0 to 20 | yes | optional | 5.0 to 15 | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Silicate | — | — | — | — | — | — |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6e

| Exemplary Cleaning Agent Combinations | | | | | | |
|---|---|---|---|---|---|---|
| | Formulation 9 | | | Formulation 10 | | |
| Ingredients (in wt. %) | A | B | C | A | B | C |
| Non-ionic surfactant | optional | 2.0 to 20 | yes | optional | 5.0 to 15 | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Phosphate | — | — | — | — | — | — |
| Silicate | — | — | — | — | — | — |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6f

| Exemplary Cleaning Agent Combinations | | | | | | |
|---|---|---|---|---|---|---|
| | Formulation 11 | | | Formulation 12 | | |
| Ingredients (in wt. %) | A | B | C | A | B | C |
| Non-ionic surfactant (hydroxy mixed ethers group) | optional | 2.0 to 20 | yes | optional | 5.0 to 15 | yes |
| Non-ionic surfactant (Y-surfactants group) | optional | optional | yes | optional | optional | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Phosphate | — | — | — | — | — | — |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6g

| Exemplary Cleaning Agent Combinations | | | | | | |
|---|---|---|---|---|---|---|
| | Formulation 13 | | | Formulation 14 | | |
| Ingredients (in wt. %) | A | B | C | A | B | C |
| Non-ionic surfactant (hydroxy mixed ethers group) | optional | 2.0 to 20 | yes | optional | 5.0 to 15 | yes |
| Non-ionic surfactant (Y-surfactants group) | optional | optional | yes | optional | optional | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Silicate | — | — | — | — | — | — |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

TABLE 6h

| Exemplary Cleaning Agent Combinations | | | | | | |
|---|---|---|---|---|---|---|
| | Formulation 15 | | | Formulation 16 | | |
| Ingredients (in wt. %) | A | B | C | A | B | C |
| Non-ionic surfactant (hydroxy mixed ethers group) | optional | 2.0 to 20 | yes | optional | 5.0 to 15 | yes |
| Non-ionic surfactant (Y-surfactants group) | optional | optional | yes | optional | optional | yes |
| Protease preparation | — | 5.0 to 50 | — | — | 10 to 30 | — |
| Amylase preparation | — | 0.1 to 30 | — | — | 2.0 to 20 | — |
| Builders | 5.0 to 60 | <10 | <10 | 15 to 40 | <5 | <5 |
| Phosphate | — | — | — | — | — | — |
| Silicate | — | — | — | — | — | — |
| Bleaching agent | — | — | — | — | — | — |
| Org. solvent | optional | 5.0 to 80 | 5.0 to 60 | optional | 12 to 60 | 12 to 60 |
| Water | 5.0 to 50 | 10 to 70 | 20 to 80 | 5.0 to 50 | 10 to 40 | 40 to 70 |
| Misc | to 100 | to 100 | to 100 | to 100 | to 100 | to 100 |

Cleaning agent combinations according to the invention comprising the cleaning agent preparations A, B and C preferably contain less than 10 wt. %, particularly preferably less than 5 wt. % and in particular less than 2 wt. % of phosphate. Phosphate-free cleaning agent combinations comprising the cleaning agent preparations A, B and C are most particularly preferred according to the invention. Cleaning agent combinations according to the invention comprising the cleaning agent preparations A, B and C are furthermore preferred which contain less than 5 wt. %, preferably less than 3 wt. % and in particular less than 1 wt. % of silicate. Most particularly preferred cleaning agent combinations according to the invention are silicate-free. Reducing the phosphate content and reducing the silicate content have both proved advantageous for the stability of the cleaning agent combinations according to the invention.

The additional cleaning agent preparation A can for example contain active washing or cleaning substances from the group of builders, glass corrosion inhibitors, corrosion inhibitors, scents and perfume carriers.

According to the present application the group of builders includes organic complexing agents as well as alkali carriers and active cleaning anionic polymers. The high builder content of cleaning agent preparations according to the invention of 30 to 90 wt. % is divided between these three groups of builders.

The group of organic complexing agents includes in particular polycarboxylates/polycarboxylic acids, polymeric carboxylates, aspartic acid, polyacetals, dextrins and further organic cobuilders such as phosphonates. These classes of substances are described below.

Organic complexing agents which can be used are for example the polycarboxylic acids which can be used in the form of the free acid and/or its sodium salts, polycarboxylic acids being understood to be those carboxylic acids carrying more than one acid function. These are for example citric acid, adipic acid, succinic acid, ethylenediamine disuccinic acid, glutaric acid, malic acid, tartaric acid, maleic acid, fumaric acid, sugar acids, aminocarboxylic acids, nitrilotriacetic acid (NTA), provided that such a use is not to be opposed on ecological grounds, and mixtures thereof. In addition to their builder action, the free acids typically also have the characteristic of an acidifying component and are thus also used to establish a lower and milder pH in washing or cleaning agents. Citric acid, succinic acid, glutaric acid, adipic acid, gluconic acid and any mixtures thereof are to be cited here in particular. Also to be mentioned as further preferred builder substances are polymeric amino dicarboxylic acids, the salts thereof or the precursor substances thereof. Polyaspartic acids or salts thereof are particularly preferred.

Additional suitable organic complexing agents are polyacetals, which can be obtained by reacting dialdehydes with polyol carboxylic acids having 5 to 7 C atoms and at least 3 hydroxyl groups. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Other suitable organic complexing agents are dextrins, for example oligomers or polymers of carbohydrates, which can be obtained by partial hydrolysis of starches. The hydrolysis can be performed by conventional methods, for example acid- or enzyme-catalyzed methods. The hydrolysis products preferably have average molar masses in the range from 400 to 500,000 g/mol. A polysaccharide having a dextrose equivalent (DE) in the range from 0.5 to 40, in particular from 2 to 30, is preferred, wherein DE is a commonly used measure for the reducing action of a polysaccharide in comparison to dextrose, which has a DE of 100. Both maltodextrins having a DE between 3 and 20 and dry glucose syrups having a DE between 20 and 37 and also yellow dextrins and white dextrins having elevated molar masses in the range from 2000 to 30,000 g/mol can be used.

The oxidized derivatives of such dextrins are their reaction products with oxidizing agents which are capable of oxidizing at least one alcohol function of the saccharide ring to the carboxylic acid function.

Oxydisuccinates and other derivatives of disuccinates, preferably ethylenediamine disuccinate, are also additional suitable cobuilders. Ethylenediamine-N,N'-disuccinate (EDDS) is preferably used here in the form of its sodium or magnesium salts. Also preferred in this context are glycerol disuccinates and glycerol trisuccinates. Suitable amounts to be used are from 3 to 15 wt. %.

The automatic dishwashing agents according to the invention contain to particular advantage methylglycinediacetic acid or a salt of methylglycinediacetic acid.

Other organic complexing agents which can be used are for example acetylated hydroxycarboxylic acids or salts thereof which can optionally also be present in the lactone form and which contain at least four carbon atoms and at least one hydroxyl group as well as a maximum of two acid groups.

Preferred cleaning agent combinations according to the invention have the characterizing feature that the cleaning agent preparation A, relative to its total weight, contains 5.0 to 60 wt. %, preferably 10 to 50 wt. % and in particular 15 to 40 wt. % of builder(s) from the group of organic complexing agents. Contents of organic complexing agents above 25 wt. %, particularly preferably above 30 wt. % and in particular above 35 wt. % are preferably achieved. The upper limit of the content of organic complexing agents is preferably 85 wt. % and in particular 75 wt. %.

Particularly preferred automatic dishwashing agents according to the invention contain citrate as their substantial organic complexing agent. Cleaning agent combinations according to the invention, wherein the cleaning agent preparation A contains 2.0 to 50 wt. %, preferably 4.0 to 40 wt. % and in particular 5.0 to 30 wt. % of citrate, are preferred according to the invention.

A second important organic complexing agent is ethylenediamine disuccinic acid (EDDS), wherein preferred cleaning agent preparations A have the characterizing feature that they contain, relative to their total weight, 3.0 to 65 wt. %, preferably 5.0 to 60 wt. % and in particular 10 to 50 wt. % of ethylenediamine disuccinic acid. Contents of ethylenediamine disuccinic acid above 12 wt. %, particularly preferably above 15 wt. % and in particular above 20 wt. % are preferably achieved. The upper limit of the content of ethylenediamine disuccinic acid is preferably 55 wt. % and in particular 45 wt. %.

Ethylenediamine disuccinic acid has proved to be particularly effective in phosphate-free cleaning agent preparations in particular, with regard to tea stain removal in automatic dishwashing.

In addition to the free acids, the term "ethylenediamine disuccinic acid" (EDDS) also encompasses salts thereof, for example sodium or potassium salts thereof. Regarding the percentage by weight of ethylenediamine disuccinic acid used in the agents according to the invention, if the acid salt is used then the percentage by weight of the free acid should be taken as a basis, in other words the percentage by weight of the salt should be converted to the percentage by weight of the acid.

The complexing phosphonates form a group of other organic complexing agents that are used to advantage in the cleaning agent preparation A according to the invention, wherein in addition to 1-hydroxyethane-1,1-diphosphonic acid this group encompasses a number of different compounds such as for example diethylenetriamine penta(methylene phosphonic acid) (DTPMP). Hydroxyalkane and aminoalkane phosphonates in particular are preferred in this application. Of particular importance as a cobuilder among the hydroxyalkane phosphonates is 1-hydroxyethane-1,1-diphosphonate (HEDP). It is preferably used as a sodium salt, wherein the disodium salt reacts neutral and the tetrasodium salt reacts alkaline (pH 9). Ethylenediamine tetramethylene phosphonate (EDTMP), diethylenetriamine pentamethylene phosphonate (DTPMP) and the higher homologs thereof are preferably suitable as aminoalkane phosphonates. They are preferably used in the form of the neutral-reacting sodium salts, for example as hexasodium salt of EDTMP or as heptasodium and octasodium salt of DTPMP. From the class of phosphonates HEDP is preferably used as the builder. The aminoalkane phosphonates additionally have a pronounced heavy-metal-binding capacity. It can accordingly be preferable to use aminoalkane phosphonates, in particular DTPMP, or mixtures of the cited phosphonates, particularly if the agents also contain bleach.

A preferred automatic dishwashing agent within the context of this application contains one or more phosphonates from the group consisting of amino trimethylene phosphonic acid (ATMP) and/or salts thereof; ethylenediamine tetra(methylene phosphonic acid) (EDTMP) and/or salts thereof; diethylenetriamine penta(methylene phosphonic acid) (DTPMP) and/or salts thereof; 1-hydroxyethane-1,1-diphosphonic acid (HEDP) and/or salts thereof; 2-phosphonobutane-1,2,4-tricarboxylic acid (PBTC) and/or salts thereof; hexamethylenediamine tetra(methylene phosphonic acid) (HDTMP) and/or salts thereof; and nitrilotri(methylene phosphonic acid) (NTMP) and/or salts thereof.

Automatic dishwashing agents containing 1-hydroxyethane-1,1-diphosphonic acid (HEDP) or diethylenetriamine penta(methylene phosphonic acid) (DTPMP) are particularly preferred as phosphonates.

The cleaning agent preparations according to the invention can of course contain two or more different phosphonates.

The percentage by weight of phosphonates in the total weight of cleaning agent preparations A according to the invention is preferably 1 to 8 wt. %, preferably 1.2 to 6 wt. % and in particular 1.5 to 4 wt. %.

Alkali carriers form a second group of builders. The group of alkali carriers includes carbonates and/or hydrogen carbonates as well as alkali hydroxides. In the context of this application the group of carbonates and hydrogen carbonates is encompassed by the term (hydrogen) carbonate.

Preferred cleaning agent combinations according to the invention have the characterizing feature that the cleaning agent preparation A, relative to its total weight, contains 1.0 to 30 wt. %, preferably 2.0 to 25 wt. % and in particular 5 to 20 wt. % of builder(s) from the group of alkali carriers.

The use of (hydrogen) carbonate(s), preferably alkali (hydrogen) carbonate(s), particularly preferably sodium (hydrogen) carbonate or potassium (hydrogen) carbonate, in amounts of 1.0 to 40 wt. %, preferably 2.0 to 30 wt. % and in particular 4.0 to 15 wt. %, relative to the total weight of the cleaning agent preparation A, is particularly preferred.

Preferred cleaning agent preparations according to the invention contain alkali hydroxide(s) to increase or adjust the alkalinity. The alkali hydroxides are preferably used in the cleaning agents in amounts between 2.0 and 20 wt. %, preferably between 3.0 and 15 wt. % and in particular between 4.0 and 12 wt. %, relative in each case to the total weight of the cleaning agent. The cleaning agent preparations A according to the invention contain potassium hydroxide to particular advantage.

Cleaning agent preparations according to the invention preferably contain less than 10 wt. %, particularly preferably less than 5 wt. % and in particular less than 2 wt. % of phosphate. Phosphate-free cleaning agent preparations A are most particularly preferred according to the invention. Cleaning agent preparations according to the invention are furthermore preferred which contain less than 2 wt. %, preferably less than 1 wt. % and in particular less than 0.5 wt. % of silicate. Most particularly preferred automatic dishwashing agents according to the invention are silicate-free. The elimination of silicate surprisingly improves the physical stability of the automatic dishwashing agents according to the invention for automatic dosing.

Active cleaning anionic polymers third a third group of builders contained in the cleaning agent preparations according to the invention.

The active cleaning anionic polymers can have two, three, four or more different monomer units. In addition to homopolymeric and copolymeric polycarboxylates, the group of these polymers also encompasses inter alia the copolymeric polysulfonates which in addition to a monomer from the group of unsaturated carboxylic acids also have at least one further monomer from the group of unsaturated sulfonic acids.

The percentage by weight of active cleaning anionic polymers in the total weight of the cleaning agent preparation A is preferably 1.0 to 30 wt. %, preferably 2.0 to 25 wt. % and in particular 5.0 to 20 wt. %.

Polymeric polycarboxylates form a first group of active cleaning anionic polymers. Examples of such polymers are the alkali metal salts of polyacrylic acid or polymethacrylic acid, for example those having a relative molar mass of 500 to 70,000 g/mol.

Suitable anionic polymers are in particular polyacrylates, which preferably have a molar mass of 2000 to 20,000 g/mol. Of this group, owing to their superior solubility, preference can in turn be given to the short-chain polyacrylates having molar masses of 2000 to 10,000 g/mol and particularly preferably 3000 to 5000 g/mol.

Also suitable are copolymeric polycarboxylates, in particular those of acrylic acid with methacrylic acid and of acrylic acid or methacrylic acid with maleic acid. Copolymers of acrylic acid with maleic acid which contain 50 to 90 wt. % of acrylic acid and 50 to 10 wt. % of maleic acid have proved to be particularly suitable. Their relative molar mass, relative to free acids, is generally 2000 to 70,000 g/mol, preferably 20,000 to 50,000 g/mol and in particular 30,000 to 40,000 g/mol.

The content of (co)polymeric polycarboxylates in preferred automatic dishwashing agents is preferably 0.5 to 20 wt. % and in particular 3 to 10 wt. %, relative in each case to the total weight of automatic dishwashing agents.

Preferred copolymeric polysulfonates C contain in addition to sulfonic acid group-containing monomer(s) at least one monomer from the group of unsaturated carboxylic acids.

Unsaturated carboxylic acids of the formula $R^1(R^2)C{=}C(R^3)COOH$ are used to particular advantage as unsaturated carboxylic acid(s), in which $R^1$ to $R^3$ independently of one another denote —H, —$CH_3$, a straight-chain or branched saturated alkyl residue having 2 to 12 carbon atoms, a straight-chain or branched, mono- or polyunsaturated alkenyl residue having 2 to 12 carbon atoms, alkyl or alkenyl residues substituted with —$NH_2$, —OH or —COOH as defined above, or —COOH or —$COOR^4$, where $R^4$ is a saturated or unsaturated, straight-chain or branched hydrocarbon residue having 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenyl acrylic acid, maleic acid, maleic anhydride, fumaric acid, itaconic acid, citraconic acid, methylene malonic acid, sorbic acid, cinnamic acid or mixtures thereof. The unsaturated dicarboxylic acids can also be used of course.

One the monomers containing sulfonic acid groups are preferred and are of the formula:

$$R^5(R^6)C{=}C(R^7)—X—SO_3H,$$

wherein $R^5$ to $R^7$ independently of one another denote —H, —$CH_3$, a straight-chain or branched saturated alkyl residue having 2 to 12 carbon atoms, a straight-chain or branched, mono- or polyunsaturated alkenyl residue having 2 to 12 carbon atoms, alkyl or alkenyl residues substituted with —$NH_2$, —OH or —COOH, or —COOH or —$COOR^4$, where $R^4$ is a saturated or unsaturated, straight-chain or branched hydrocarbon residue having 1 to 12 carbon atoms, and X denotes an optionally present spacer group, which is selected from $—(CH_2)_n—$ where n=0 to 4, —COO—$(CH_2)_k$— where k=1 to 6, —C(O)—NH—$C(CH_3)_2$— and —C(O)—NH—$CH(CH_2CH_3)$—.

Of these, the preferred monomers are those of the formulae:

$$H_2C{=}CH—X—SO_3H,$$

$$H_2C{=}C(CH_3)—X—SO_3H, \text{ and}$$

$$HO_3S—X—(R^6)C{=}C(R^7)—X—SO_3H,$$

wherein $R^6$ and $R^7$ are selected independently of each other from —H, —$CH_3$, —$CH_2CH_3$, —$CH_2CH_2CH_3$, —$CH(CH_3)_2$ and X denotes an optionally present spacer group, which is selected from $—(CH_2)_n—$ where n=0 to 4, —COO—$(CH_2)_k$— where k=1 to 6, —C(O)—NH—$C(CH_3)_2$— and —C(O)—NH—$CH(CH_2CH_3)$—.

Particularly preferred monomers containing sulfonic acid groups are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzenesulfonic acid, methallyloxybenzenesulfonic acid, 2-hydroxy-3-(2-propenyloxy)propanesulfonic acid, 2-methyl-2-propene1-sulfonic acid, styrenesulfonic acid, vinylsulfonic acid, 3-sulfopropyl acrylate, 3-sulfopropyl methacrylate, sulfomethacrylamide, sulfomethyl methacrylamide and mixtures of the cited acids or water-soluble salts thereof.

The sulfonic acid groups can be present in the polymers wholly or partially in neutralized form, i.e. the acid hydrogen atom of the sulfonic acid group in some or all sulfonic acid groups can be exchanged for metal ions, preferably alkali metal ions, and in particular for sodium ions. The use of partially or completely neutralized sulfonic acid group-containing copolymers is preferred according to the invention.

The monomer distribution of the copolymers preferably used according to the invention, in the case of copolymers containing monomers from groups i) and ii) only, is preferably 5 to 95 wt. % of i) and ii) respectively, particularly preferably 50 to 90 wt. % of monomer from group ii) and 10 to 50 wt. % of monomer from group i), relative in each case to the polymer.

The molar mass of the sulfo-copolymers preferably used according to the invention can be varied in order to adjust the polymer properties to the desired application. Preferred automatic dishwashing agents have the characterizing feature that the copolymers have molar masses of 2,000 to 200,000 $g\text{-}mol^{-1}$, preferably 4,000 to 25,000 $g\text{-}mol^{-1}$, and in particular 5,000 to 15,000 $g\text{-}mol^{-1}$.

In a further preferred embodiment, the copolymers encompass, in addition to the carboxyl group-containing monomer and sulfonic acid group-containing monomer, at least one non-ionic, preferably hydrophobic monomer. The use of these hydrophobically modified polymers has made it possible to improve in particular the rinsing performance of automatic dishwashing agents according to the invention.

Automatic dishwashing agents wherein the automatic dishwashing agent contains as anionic copolymer a copolymer comprising:

i) carboxylic acid group-containing monomer(s);

ii) sulfonic acid group-containing monomer(s); and iii) non-ionic monomer(s), are preferred according to the invention.

Monomers of the general formula $R^1(R^2)C{=}C(R^3)—X—R^4$ are preferably used as non-ionic monomers, in which $R^1$ to $R^3$ independently of one another denote —H, —$CH_3$ or —$C_2H_5$, X denotes an optionally present spacer group, which is selected from —$CH_2$—, —C(O)O— and —C(O)—NH—, and $R^4$ denotes a straight-chain or branched, saturated alkyl residue having 2 to 22 carbon atoms or an unsaturated, preferably aromatic residue having 6 to 22 carbon atoms.

Particularly preferred non-ionic monomers are butene, isobutene, pentene, 3-methylbutene, 2-methylbutene, cyclopentene, hexene, hexene-1,2-methylpentene-1,3-methylpentene-1, cyclohexene, methylcyclopentene, cycloheptene, methylcyclohexene, 2,4,4-trimethylpentene-1,2,4,4-trimethylpentene-2,2,3-dimethylhexene-1,2,4-dimethylhexene-1,2,5-dimethylhexene-1,3,5-dimethylhexene-1,4,4-dimethylhexane-1, ethylcyclohexyne, 1-octene, α-olefins having 10 or more carbon atoms, such as for example 1-decene, 1-dodecene, 1-hexadecene, 1-octadecene and C22-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl) acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl)acrylamide, behenyl acrylate, behenyl methacrylate and N-(behenyl)acrylamide or mixtures thereof.

Preferred cleaning agent combinations according to the invention have the characterizing feature that the cleaning agent combination encompasses a further, preferably liquid, cleaning agent A, containing: (a1) at least one builder from the group of organic complexing agents; and, (a2) at least one builder from the group of active cleaning polymers.

The aforementioned combination of cleaning agents is packaged for example using a packaging means in which the washing or cleaning preparations B and C are separate from one another. This separation can be achieved for example by means of separate holding chambers, each of which contains one of the cleaning agents that are combined with one another. Examples of such packaging forms are cartridges having two, three, four or more separate holding chambers, for example two-, three-, four- or multi-chamber bottles. Separating the cleaning agents of differing compositions can eliminate unwanted reactions owing to chemical incompatibility.

The present application also provides a cleaning agent presentation form for automatic dosing in automatic dishwashing, comprising: (a) a cleaning agent combination according to the invention in a sufficient amount for at least two, preferably at least four and in particular at least eight automatic dishwasher processes; and (b) a cartridge for the cleaning agent combination in which the preferably liquid cleaning agents B and C are separated from each other.

The formulations disclosed in TABLES 1-5 are particularly suitable here.

The present application also preferably provides: A cleaning agent presentation form for automatic dosing in automatic dishwashing, comprising: (a) a cleaning agent combination comprising: (1) a cleaning agent preparation A comprising: (a1) at least one builder from the group of organic complexing agents; (2) a cleaning agent preparation B comprising: (b1) at least one non-ionic surfactant; and (b2) at least one active cleaning enzyme; and (3) a rinsing composition C comprising: (c1) at least one non-ionic surfactant, in a sufficient amount for at least two, preferably at least four and in particular at least eight automatic dishwasher processes; and (b) a cartridge for the cleaning agent combination in which the preferably liquid cleaning agents A, B and C are separated from one another.

The formulations disclosed in TABLES 1-6 are particularly suitable here.

In a preferred embodiment the aforementioned cartridges of the cleaning agent presentation forms are provided with a dosing device which is removable from the cartridge. Such a dosing device can be connected to the cartridge by means of an adhesive, latching, snap-on or plug-in connection, for example. The separation of cartridge and dosing device makes it easier to fill the cartridge, for example. Alternatively, the removable connection of cartridge and dosing device allows the cartridges in the dosing device to be replaced. Such a replacement can be indicated for example if the cleaning program is changed or when the cartridge is completely empty.

The present application also provides a cleaning agent dosing system for automatic dosing in automatic dishwashing, comprising: a) a cleaning agent combination according to the invention in a sufficient amount for at least two, preferably at least four and in particular at least eight automatic dishwasher processes; b) a cartridge for the cleaning agent combination in which the preferably liquid cleaning agents B and C are separated from each other; and c) a dosing device removably connected to the cartridge.

The formulations disclosed in TABLES 1-5 are particularly suitable here.

The present invention additionally comprises a cleaning agent dosing system for automatic dosing in automatic dishwashing, comprising: a) a cleaning agent combination comprising: a cleaning agent preparation A containing: (a1) at least one builder from the group of organic complexing agents; a cleaning agent preparation B containing: (b1) at least one non-ionic surfactant; and (b2) at least one active cleaning enzyme; and a rinsing composition C containing: (c1) at least one non-ionic surfactant, in a sufficient amount for at least two, preferably at least four and in particular at least eight automatic dishwasher processes; b) a cartridge for the cleaning agent combination in which the preferably liquid cleaning agents A, B and C are separated from one another; and c) a dosing device removably connected to the cartridge.

The formulations disclosed in Tables 1 to 6 are suitable here in particular.

Cleaning agent dosing systems are naturally also conceivable in which the cartridge and dosing device are connected to each other irremovably. However, the advantage of the removable connection between the cartridge and the dosing device is that the dosing device can be used several times, in other words in combination with multiple cartridges (reusable dosing device).

The present application also provides a cleaning agent dosing system comprising: a) a cleaning agent combination according to the invention in a sufficient amount for at least two, preferably at least four and in particular at least eight automatic dishwasher processes; b) a cartridge for the cleaning agent combination in which the liquid cleaning agents B and C are separated from each other; and c) a dosing device irremovably connected to the cartridge.

The formulations disclosed in Tables 1 to 5 are suitable here in particular.

The present application preferably also provides a cleaning agent dosing system for automatic dosing in automatic dishwashing comprising: a) a cleaning agent combination comprising: a cleaning agent preparation A including: (a1) at least one builder from the group of organic complexing agents; a cleaning agent preparation B including: (b1) at least one non-ionic surfactant; and (b2) at least one active cleaning enzyme; and a rinsing composition C including: (c1) at least one non-ionic surfactant, in a sufficient amount for at least two, preferably at least four and in particular at least eight automatic dishwasher processes; b) a cartridge for the cleaning agent combination in which the preferably liquid cleaning agents A, B and C are separated from one another; and c) a dosing device irremovably connected to the cartridge.

The formulations disclosed in Tables 1 to 6 are suitable here in particular.

In a preferred embodiment the aforementioned cleaning agent dosing systems, comprising the cleaning agent presentation form according to the invention (and optionally one or two further cleaning agents differing from the cleaning agent preparations B and C according to the invention), a cartridge and a dosing device removably connected to the cartridge, are contained in a common outer packaging, wherein the filled cartridge and the dosing device are particularly preferably contained separately from one another in the outer packaging. The outer packaging serves for storage, transport and presentation of the cleaning agent presentation form according to the invention and protects it against dirt, impact and crushing. For presentation purposes in particular, at least part of the outer packaging should be transparent in design.

Alternatively or in addition to an outer packaging, it is of course also possible to market the cleaning agent presentation form according to the invention in conjunction with an automatic dishwasher. Such a combination is advantageous in particular in cases in which the course of the automatic dishwashing method (e.g. duration, temperature progression, water infeed) and the cleaning agent formulation or the electronic controls of the dosing device are matched to one another.

The dosing system according to the invention consists of the basic components of a cartridge filled with the cleaning agent according to the invention and a dosing device that can be coupled to the cartridge, which dosing device is in turn formed from further modules, such as for example component support, actuator, closing element, sensor, power source and/or control unit.

It is preferable for the dosing system according to the invention to be movable. The term movable herein means that the dosing system is not irremovably connected to a water-carrying appliance such as, for example, an automatic dishwasher, washing machine, washer-dryer or the like, but instead can for example be removed from an automatic dishwasher or placed in an automatic dishwasher by the user. In other words, it can be handled autonomously.

According to an alternative embodiment of the invention it is also conceivable that for the user the dosing device is not removably connected to a water-carrying appliance such as for example an automatic dishwasher, washing machine, washer-dryer or the like and that only the cartridge is movable.

As the preparations for dosing can have a pH of between 2 and 12, depending on the intended usage, all components of the dosing system that come into contact with the preparations should have an appropriate resistance to acids and/or alkalis. These components should furthermore be as chemically inert as possible, in respect of for example non-ionic surfactants, enzymes and/or scents, through the choice of an appropriate material.

Cartridge

A cartridge within the meaning of this application is understood to be a packaging means which is suitable for encasing or holding together free-flowing or scatterable preparations and which can be coupled to a dosing device to dispense the preparation.

A cartridge can in particular also encompass a plurality of chambers which can be filled with mutually different compositions. It is also conceivable that a number of containers are configured to form a cartridge unit.

It is advantageous for the cartridge to have at least one discharge opening configured in such a way that preparation can be released from the container under the action of shear forces when the dosing device is in its usage position. In this way no further conveying means is necessary for releasing preparation from the container, thus allowing the design of the dosing device to be kept simple and the production costs low.

In a preferred embodiment of the invention at least a second chamber is provided to hold at least a second free-flowing or scatterable preparation, wherein the second chamber has at least one discharge opening configured in such a way that product is released from the second chamber under the action of shear forces when the dosing device is in its usage position. The arrangement of a second chamber is advantageous in particular if preparations are stored in the separate containers which conventionally are not stable when stored together, such as for example bleaching agents and enzymes.

It is furthermore conceivable for more than two, in particular three to four chambers to be provided in or on a cartridge. In particular, one of the chambers can be designed to dispense volatile preparations such as for instance a scent into the environment.

In a further embodiment of the invention the cartridge is designed in one piece. In this way the cartridges can be formed at low cost in a single manufacturing step, by means of appropriate blow molding methods in particular. The chambers of a cartridge can be separated from one another here by means of walls or material bridges for example.

The cartridge can also be formed in multiple pieces from components manufactured by injection molding and then joined together.

It is also conceivable for the cartridge to be formed in multiple pieces in such a way that at least one chamber, preferably all chambers, can be removed individually from the dosing device or placed individually in the dosing device. In this way, where the consumption of a preparation from one chamber is disproportionately high, an empty chamber can be replaced while the other chambers, which may still contain preparation, remain in the dosing device. A selective refilling of the individual chambers or of the preparations therein can thus be achieved according to need.

The chambers of a cartridge can be fixed to one another by suitable connection methods to form a container unit. The chambers can be fixed to one another removably or irremovably by means of a suitable positive, non-positive or adhesive connection. In particular the fixing can take place by one or more of the connection types from the group of snap-in connections, hook and loop connections, press-fit connections, fused connections, adhesive connections, welded connections, soldered connections, screwed connections, keyed connections, clamped connections, or resilient connections. The fixing can also be formed in particular from a shrink sleeve, which is pulled over all or part of the cartridge when hot and then permanently encloses the chambers or cartridge when cooled.

To provide advantageous residual emptying properties of the chambers, the floor of the chambers can be funnel-shaped and inclined towards the discharge opening. Furthermore, through appropriate choice of material and/or surface design, the inner wall of a chamber can be designed so as to minimize material adhesion of the preparation to the inner chamber wall. This measure also further optimizes the residual emptying ability of a chamber.

The chambers of a cartridge can have identical or different capacities. In a configuration with two chambers the ratio of container capacities is preferably 5:1. In a configuration with three chambers it is preferably 4:1:1. These configurations are particularly suitable for use in automatic dishwashers.

As mentioned above, the cartridge preferably has three chambers. For the use of such a cartridge in an automatic dishwasher it is preferable in particular for the first chamber to contain an alkaline cleaning preparation, the second chamber an enzymatic preparation and the third chamber a rinse aid, the ratio of capacities of the chambers being approximately 4:1:1.

A dosing chamber can be formed in or on one chamber ahead of the discharge opening in the direction of flow of the preparation. The dosing chamber determines the amount of preparation to be dispensed to the environment when preparation is released from the chamber. This is advantageous in particular if the closing element of the dosing device which dispenses preparation from a chamber to the environment can only be moved to an open and closed position, without any control of the amount to be dispensed. The dosing chamber then ensures that a predefined amount of preparation is released, without direct feedback of the amount of preparation dispensed. The dosing chambers can be formed in one piece or in multiple pieces.

According to a further advantageous developed form of the invention, one or more chambers have a liquid-tight closable chamber opening in addition to a discharge opening. This chamber opening can be used for example for topping up preparation stored in this chamber.

Venting options can be provided in the head region of the cartridge in particular for venting the cartridge chambers to ensure pressure compensation between the inside of the cartridge chambers and the environment as the fill level of the chambers drops. These venting options can be designed for example as a valve, in particular a silicone valve, as microscopic openings in the cartridge wall or the like.

If in accordance with a further embodiment the cartridge chambers are not to be vented directly but rather via the dosing device or not vented at all, for example where the use of flexible containers such as pouches is provided, this has the advantage that at elevated temperatures during a dishwasher rinse cycle a pressure is built up through the heating of the chamber contents which pushes the preparations being dosed towards the discharge openings, thus allowing a good residual emptying ability of the cartridge to be achieved. Furthermore, in an air-free pack of this type there is no risk of oxidation of substances of the preparation, such that a pouch pack or bag-in-bottle pack appears convenient for oxidation-sensitive preparations in particular.

The cartridge conventionally has a capacity of <5000 ml, in particular <1000 ml, preferably <500 ml, particularly preferably <250 ml, most particularly preferably <50 ml.

The cartridge can assume any physical shape. For example it can be cube-like, spherical or flat in shape.

The cartridge and the dosing device can in particular be shaped in such a way as to ensure the minimum possible effective volume loss, in an automatic dishwasher in particular.

For use of the dosing device in automatic dishwashers it is particularly advantageous to base the shape of the device on the dishes to be cleaned in the dishwasher. Thus it can be designed in a flat shape, for example, in the approximate dimensions of a plate. This allows the dosing device to be positioned in a space-saving manner, for example in the lower basket of the automatic dishwasher. Furthermore, the user immediately knows the correct position for the dosing unit intuitively from the plate-like shape. The cartridge preferably has a height:width:depth ratio of between 5:5:1 and 50:50:1, preferably of approximately 10:10:1 in particular. Such a "slimline" design of the dosing device and the cartridge makes it possible in particular for the device to be positioned in the lower basket of an automatic dishwasher in the slots designed for plates. This has the advantage that the preparations dispensed from the dosing device are introduced directly into the washing liquor and cannot adhere to the other items to be washed.

Standard domestic dishwashers are conventionally designed in such a way that larger items such as pans or large plates are placed in the lower basket of the dishwasher. To prevent a non-optimum positioning of the dosing system by the user in the upper basket, in an advantageous embodiment of the invention the dosing system is dimensioned in such a way that the dosing system can only be placed in the designated slots in the lower basket. To this end the width and height of the dosing system can be chosen in particular between 150 mm and 300 mm, particularly preferably between 175 mm and 250 mm.

It is however also conceivable for the dosing unit to be designed in a bowl shape with a substantially circular or square base.

To protect heat-sensitive constituents of a preparation contained in a cartridge against the effect of heat it is advantageous to manufacture the cartridge from a material having low heat conductivity.

Another option for reducing the influence of heat on a preparation in a chamber of the cartridge is to insulate the chamber by appropriate means, for example by the use of heat-insulating materials such as Styropor, which partially or completely enclose the chamber or the cartridge in a suitable manner.

In a preferred embodiment of the invention the cartridge has an RFID label, which as a minimum contains information about the content of the cartridge and can be read by the sensor unit.

This information can be used to select a dosing program stored in the control unit. This can ensure that an optimum dosing program is always used for a particular preparation. It can also be provided that in the absence of an RFID label or with an RFID label bearing an incorrect or faulty code, no dosing is carried out by the dosing device and instead an optical or acoustic signal is generated, which alerts the user to the fault.

To eliminate misuse of the cartridge, the cartridges can also have structural elements which combine with corresponding elements of the dosing device in accordance with the key-lock principle, such that for example only cartridges of a particular model can be coupled to the dosing device. This design furthermore allows information about the cartridge coupled to the dosing device to be transferred to the control unit, as a result of which the control of the dosing device can be adapted to the content of the corresponding container.

The cartridge is designed in particular to hold free-flowing washing or cleaning agents. Such a cartridge particularly preferably has a number of chambers for the physically separate accommodation of different preparations of a washing or cleaning agent.

The cartridge can be designed in such a way that it can be removably or fixedly positioned in or on the automatic dishwasher.

Dosing Device

The control unit, sensor unit and at least one actuator necessary for operation are integrated in the dosing device. A power source is preferably likewise located in the dosing device.

The dosing device preferably consists of a splash-proof housing, which prevents water spray, such as can occur for example when used in an automatic dishwasher, from penetrating into the interior of the dosing device.

It is particularly preferable for the dosing device to encompass at least a first interface, which combines with a corresponding interface formed in or on a water-carrying appliance such as in particular a water-carrying domestic appliance, preferably an automatic dishwasher or washing machine, in such a way that a transfer of electrical energy is realized from the water-carrying appliance to the dosing device.

In one embodiment of the invention the interfaces are formed by plug-in connectors. In a further embodiment the interfaces can be formed in such a way that a wireless transfer of electrical energy is realized.

In an advantageous developed form of the invention a second interface is formed on the dosing device and on the water-carrying appliance, such as for instance an automatic dishwasher, for the transfer of electromagnetic signals which in particular represent operating status information, measurement and/or control data for the dosing device and/or the water-carrying appliance such as an automatic dishwasher Adapter A simple coupling of the dosing system to a water-carrying domestic appliance can be achieved with an adapter. The adapter is used for the mechanical and/or electrical connection of the dosing system to the water-carrying domestic appliance.

The adapter is preferably fixedly connected to a water-carrying pipe of the domestic appliance. It is however also conceivable to design the adapter to be positioned in or on the domestic appliance such that the adapter is in the path of the water flow and/or spray jet of the domestic appliance.

The adapter makes it possible to design a dosing system for both an autonomous and a "built-in" version. It is also possible to design the adapter as a kind of charging station for the dosing system, in which for example the power source of the dosing device is charged or data exchanged between the dosing device and the adapter.

In an automatic dishwasher the adapter can be positioned on one of the inner walls of the rinsing chamber, in particular on the inside of the dishwasher door. It is however also conceivable for the adapter as such to be positioned in the water-carrying domestic appliance so that is not accessible to the user, such that the dosing device is inserted into the adapter at the time of installation with the domestic appliance for example, wherein the adapter, the dosing device and the domestic appliance are designed in such a way that a cartridge can be coupled to the dosing device by the user.

As mentioned at the start, the cleaning agents according to the invention have a particular physical and chemical stability, in particular in respect of temperature fluctuations. The cleaning agents according to the invention are thus exceptionally suitable for dosing by means of a dosing system located in the interior of a washing machine or automatic dishwasher. Such a dosing system, which can be fixedly integrated in the interior of the washing machine or automatic dishwasher (machine-integrated dosing device) but which can naturally also be introduced into the interior as a movable device (autonomous dosing device), contains multiples of the amount of cleaning agent necessary for one automatic dishwasher process.

Movable within the meaning of this application means that the dispensing and dosing system are not irremovably connected to an appliance such as, for example, an automatic dishwasher, washing machine, washer-dryer, or the like, but instead can for be removed from an automatic dishwasher or placed in an automatic dishwasher.

The present application also provides the use of a cleaning agent combination according to the invention to fill: (i) a cartridge of a dosing system fixedly integrated in the interior of an automatic dishwater; or, (ii) a movable cartridge of a dosing system designed to be placed in the interior of an automatic dishwasher with a sufficient amount of said cleaning agent combination for at least two, preferably at least four and in particular at least eight automatic dishwasher processes. As mentioned above, the cleaning agent combination can encompass two cleaning agent preparations B and C or, alternatively, three cleaning agent preparations A, B and C. The formulations disclosed in Tables 1 to 6 are suitable in particular for the aforementioned use.

As an alternative to the cleaning agent combination according to the invention, a cleaning agent presentation form according to the invention comprising the cleaning agent combination and a cartridge containing the cleaning agent preparations B and C can of course also be used to fill a dosing device.

The present application thus also provides the use of a cleaning agent presentation form as a cleaning agent reservoir for: (i) a dosing device fixedly integrated in the interior of an automatic dishwasher; or, (ii) a movable dosing device designed to be placed in the interior of an automatic dishwasher.

This application likewise provides in particular the use of a cleaning agent presentation form according to the invention to fill: (i) a dosing system fixedly integrated in the interior of an automatic dishwasher; or, (ii) a movable dosing system designed to be placed in the interior of an automatic dishwasher, with a sufficient amount of said cleaning agent presentation form for at least two, preferably at least four and in particular at least eight automatic dishwasher processes. As mentioned above, the cleaning agent presentation form can encompass two cleaning agent preparations B and C or, alternatively, three cleaning agent preparations A, B and C. The formulations disclosed in Tables 1 to 6 are suitable in particular for the aforementioned use.

An example of a fixed cartridge is a container that is fixedly integrated in the interior, for example in the side wall or the inner lining of the door, of an automatic dishwasher.

An example of a movable cartridge is a container that is placed by the consumer in the interior of the automatic dishwasher and remains there throughout the course of a wash cycle. Such a cartridge can be integrated in the interior by simply placing it in the cutlery basket or crockery basket, for example, but can also be removed again by the consumer from the interior of the automatic dishwasher.

Dosing of the cleaning agent or of the cleaning agent combination from the cartridge into the interior of the automatic dishwasher takes place as described above, preferably by means of a dosing device which is removable from the cartridge. Such a dosing device can be connected to the cartridge by means of an adhesive, latching, snap-on or plug-in connection. Cartridges with an irremovably connected dosing device can of course also be used, however.

The use of a cleaning agent presentation form according to the invention as a cleaning agent reservoir for: (i) a dosing device fixedly integrated in the interior of an automatic dishwasher; or, (ii) a movable dosing device designed to be placed in the interior of an automatic dishwasher.

As mentioned above, the cleaning agent presentation form can encompass two cleaning agent preparations B and C or alternatively three cleaning agent preparations A, B and C. The formulations disclosed in Tables 1 to 6 are suitable in particular for the aforementioned use.

The present application also provides the use of a cleaning agent dosing system according to the invention as a cleaning agent reservoir for an automatic dishwasher.

The present invention also provides the use of a cleaning agent presentation form according to the invention, comprising:

a) a cleaning agent preparation B according to the invention in a sufficient amount for at least two, preferably at least four and in particular at least eight automatic dishwasher processes;

b) at least one further cleaning agent preparation C differing from B in a sufficient amount for at least two, preferably at least four and in particular at least eight automatic dishwasher processes; and, c) a cartridge for the cleaning agent preparations B and C, in which the cleaning agent preparations B and C are present in separate holding chambers, as a cleaning agent reservoir for: (i) a dosing device fixedly integrated in the interior of an automatic dishwasher; or, (ii) a movable dosing device designed to be placed in the interior of an automatic dishwasher.

The formulations disclosed in Tables 1 to 5 are suitable in particular for the aforementioned use.

Also claimed is the use of a cleaning agent presentation faint according to the invention, comprising:

a) a cleaning agent preparation A in a sufficient amount for at least two, preferably at least four and in particular at least eight automatic dishwasher processes;

b) a further cleaning agent preparation B according to the invention differing from A in a sufficient amount for at least two, preferably at least four and in particular at least eight automatic dishwasher processes;

c) at least one further cleaning agent preparation C differing from A and B in a sufficient amount for at least two, preferably at least four and in particular at least eight automatic dishwasher processes; and d) a cartridge for the cleaning agent preparations A, B and C, in which the cleaning agent preparations A, B and C are present in separate holding chambers, as a cleaning agent reservoir for:

(iii) a dosing device fixedly integrated in the interior of an automatic dishwasher; or, (iv) a movable dosing device designed to be placed in the interior of an automatic dishwasher.

The formulations disclosed in Tables 1 to 6 are suitable in particular for the aforementioned use.

In summary, both the cleaning agent combinations according to the invention, and the cleaning agent presentation forms according to the invention, are suitable as refill packs both for dosing devices fixedly integrated in the interior of an automatic dishwasher and for movable dosing devices designed to be placed in the interior of an automatic dishwasher.

The cleaning agents and cleaning agent combinations according to the invention are used, as previously described, as automatic dishwashing agents. Not only the cleaning agent presentation forms according to the invention but also the cleaning agent dosing systems according to the invention can of course be used in the dishwashing methods according to the invention.

The present application also provides automatic dishwashing methods using a cleaning agent combination according to the invention or a cleaning agent presentation form according to the invention or a cleaning agent dosing system according to the invention, wherein in the course of said method, from a cartridge located in the interior of the dishwasher,

- a partial amount b of the cleaning agent preparation B contained in the cartridge is dosed into the interior of the dishwasher, a residual amount of the cleaning agent preparation B contained in the cartridge remaining inside the cartridge until the end of the dishwashing method and this residual amount corresponding to at least twice, preferably at least four times and in particular at least eight times the amount of the partial amount b; and
- a partial amount c of the cleaning agent preparation C contained in the cartridge is dosed into the interior of the dishwasher, a residual amount of the cleaning agent preparation C contained in the cartridge remaining inside the cartridge until the end of the dishwashing method and this residual amount corresponding to at least twice, preferably at least four times and in particular at least eight times the amount of the partial amount c.

The formulations disclosed in Tables 1 to 5 are suitable in particular for the aforementioned method.

Preferred automatic dishwashing methods using a cleaning agent combination according to the invention or a cleaning agent presentation form according to the invention or a cleaning agent dosing system according to the invention have the characterizing feature that in the course of said method, from a cartridge located in the interior of the dishwasher:

- a partial amount a of the cleaning agent preparation A contained in the cartridge is dosed into the interior of the dishwasher, a residual amount of the cleaning agent preparation A contained in the cartridge remaining inside the cartridge until the end of the dishwashing method and this residual amount corresponding to at least twice, preferably at least four times and in particular at least eight times the amount of the partial amount a;
- a partial amount b of the cleaning agent preparation B contained in the cartridge is dosed into the interior of the dishwasher, a residual amount of the cleaning agent preparation B contained in the cartridge remaining inside the cartridge until the end of the dishwashing method and this residual amount corresponding to at least twice, preferably at least four times and in particular at least eight times the amount of the partial amount b; and,
- a partial amount c of the cleaning agent preparation C contained in the cartridge is dosed into the interior of the dishwasher, a residual amount of the cleaning agent preparation C contained in the cartridge remaining inside the cartridge until the end of the dishwashing method and this residual amount corresponding to at least twice, preferably at least four times and in particular at least eight times the amount of the partial amount c.

The formulations disclosed in Tables 1 to 6 are suitable in particular for the aforementioned method.

In a preferred embodiment the dosing of cleaning agent preparation B and of cleaning agent preparation C takes place at different times in the wash cycle. Automatic dishwashing methods wherein the dosing of the cleaning agents B and C takes place with a time delay, the dosing of the cleaning agent preparation B preferably taking place during the main wash cycle while the rinsing composition C is preferably dosed during the rinse cycle, are preferred according to the invention.

This application therefore preferably also provides an automatic dishwashing method using a cleaning agent combination according to the invention, a cleaning agent presentation form according to the invention or a cleaning agent dosing system according to the invention, in the course of which:

a) at a time t1, from a cartridge located in the interior of the dishwasher, a partial amount b of the cleaning agent preparation B according to the invention contained in the cartridge is dosed into the interior of the dishwasher, a residual amount of the cleaning agent preparation contained in the cartridge remaining inside the cartridge until the end of the dishwashing method, which residual amount corresponds to at least twice, preferably at least four times and in particular at least eight times the amount of the partial amount b; and b) at at least one further time t2≠t1, from a cartridge located in the interior of the dishwasher, a partial amount c of the cleaning agent preparation C contained in the second cartridge and differing from cleaning agent preparation B according to the invention is dosed into the interior of the dishwasher, a residual amount of the cleaning agent preparation contained in this cartridge remaining inside the cartridge until the end of the dishwashing method, which residual amount corresponds to at least twice, preferably at least four times and in particular at least eight times the amount of the partial amount c.

In preferred embodiments of the automatic dishwashing methods described above with time-delayed dosing of the washing or cleaning agent preparations B and C or A, B and C, time t2 is chronologically at least 1 minute, preferably at least 2 minutes and in particular between 3 and 20 minutes before or after time t1. Time t2 is preferably chronologically at least 1 minute, preferably at least 2 minutes and in particular between 3 and 20 minutes after time t1. The formulations disclosed in Tables 1 to 6 are suitable in particular for these methods.

This application also claims an automatic dishwashing method using a cleaning agent according to the invention or a cleaning agent combination according to the invention or a cleaning agent presentation form according to the invention or a cleaning agent dosing system according to the invention, in the course of which:

a) at a time t1, from a cartridge located in the interior of the dishwasher, a partial amount a of the cleaning agent preparation A according to the invention contained in the cartridge is dosed into the interior of the dishwasher, a residual amount of the cleaning agent preparation A contained in the cartridge remaining inside the cartridge until the end of the dishwashing method, which residual amount corresponds to at least twice, preferably at least four times and in particular at least eight times the amount of the partial amount a;

b) at at least one further time t2≠t1, from a cartridge located in the interior of the dishwasher, a partial amount b of the cleaning agent preparation B contained in the second cartridge and differing from cleaning agent preparation A according to the invention is dosed into the interior of the dishwasher, a residual amount of the cleaning agent preparation B contained in this cartridge remaining inside the cartridge until the end of the dishwashing method, which residual amount corresponds to at least twice, preferably at least four times and in particular at least eight times the amount of the partial amount b; and c) at at least one further time t3≠t2≠t1, from a cartridge located in the interior of the dishwasher, a partial amount c of the cleaning agent preparation C contained in the third cartridge and differing from cleaning agent preparation A according to the invention and cleaning agent preparation B is dosed into the interior of the dishwasher, a residual amount of the cleaning agent preparation C contained in this cartridge remaining inside the cartridge until the end of the dishwashing method, which residual amount corresponds to at least twice, preferably at least four times and in particular at least eight times the amount of the partial amount c.

The present application lastly provides the use of a cleaning agent combination according to the invention, a cleaning agent presentation form according to the invention or a cleaning agent dosing system according to the invention for washing dishes in an automatic dishwashing method.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

We claim:

1. A cleaning agent combination for automatic dosing in automatic dishwashing, said combination comprising:

a) an aqueous cleaning agent preparation B comprising:

i) (b1) between 2.0 and 20% by weight of the preparation B by weight of preparation B of at least one non-ionic surfactant; and ii) (b2) at least one active cleaning enzyme; and b) an aqueous rinsing composition C comprising:

i) (c1) at least one non-ionic surfactant, wherein said preparation B and said composition C are physically separated and wherein composition C contains no enzyme.

2. The cleaning agent combination of claim 1, wherein said non-ionic surfactant (b1) in cleaning agent preparation B comprises at least 20 wt. % of the total amount of surfactant in the cleaning agent combination.

3. The cleaning agent combination of claim 2, wherein said non-ionic surfactant (b1) in cleaning agent preparation B comprises between 40 and 70 wt. % of the total amount of surfactant in the cleaning agent combination.

4. The cleaning agent combination of claim 1, wherein said non-ionic surfactant (b1) in cleaning agent preparation B and/or non-ionic surfactant (c1) in rinsing composition C is a surfactant of the general formula $R^1CH(OH)CH_2O—(CH_2CH_2O)_{10-120}—R^2$, wherein $R^1$ and $R^2$ independently denote a linear or branched aliphatic hydrocarbon residue having 2 to 20 carbon atoms.

5. The cleaning agent combination of claim 1, wherein the percentage by weight of non-ionic surfactant (b1) in the total weight of cleaning agent preparation B is between 5.0 and 15 wt. %.

6. The cleaning agent combination of claim 1, wherein said preparation B and/or composition C, relative to its total weight, contains between 5.0 and 80 wt. % of an organic solvent.

7. The cleaning agent combination of claim 6, wherein said preparation B and/or composition C, relative to its total weight, contains between 12 and 60 wt. % of an organic solvent.

8. The cleaning agent combination of claim 1, wherein said at least one active cleaning enzyme (b2) in cleaning agent preparation B comprises 0.1 to 30 wt. % amylase preparation relative to the total weight of cleaning agent preparation B.

9. The cleaning agent combination of claim 8, wherein said amylase preparation is present at from 2.0 to 20 wt. %.

10. The cleaning agent combination of claim 1, wherein said at least one active cleaning enzyme (b2) in cleaning agent preparation B comprises 5 to 50 wt. % protease preparation relative to the total weight of cleaning agent preparation B.

11. The cleaning agent combination of claim 10, wherein said protease preparation is present at from 10 to 30 wt. %.

12. The cleaning agent combination of claim 1, further comprising an aqueous cleaning agent A, said cleaning agent A comprising:

a) at least one builder (a1) selected from the group consisting of organic complexing agents; and b) at least one builder (a2) selected from the group consisting of active cleaning polymers, wherein said cleaning agent A is physically separated from both preparation B and composition C.

13. The cleaning agent combination of claim 12, wherein said builder (a1) is present from 5.0 to 60 wt. % relative to the total weight of cleaning agent A.

14. The cleaning agent combination of claim 12, where said builder (a1) is present from 15 to 40 wt. % relative to the total weight of cleaning agent A.

15. A cleaning agent presentation form comprising:

a) the cleaning agent combination of claim 1 in a sufficient amount for at least two automatic dishwasher processes; and b) a cartridge for the cleaning agent combination, wherein the cleaning agent preparation B and the rinsing composition C are separated from each other.

16. A cleaning agent dosing system comprising:

a) the cleaning agent combination of claim 1 in a sufficient amount for at least two eight automatic dishwasher processes;

b) a cartridge for said cleaning agent combination in which said cleaning agent preparation B and rinsing composition C are separated from each other; and c) a dosing device removably connected to the cartridge.

* * * * *